United States Patent [19]

Maubach et al.

[11] Patent Number: 4,467,889

[45] Date of Patent: Aug. 28, 1984

[54] LADDER-GUIDED SERVICE ELEVATOR

[76] Inventors: Gerd Maubach, Schwarzdornstr. 10, D-4040 Neuss 21; Franz-Günter Vogel, Humboldt 41, D-4019 Monheim, both of Fed. Rep. of Germany

[21] Appl. No.: 433,004

[22] Filed: Oct. 6, 1982

[30] Foreign Application Priority Data

Oct. 9, 1981 [DE] Fed. Rep. of Germany ..... 3140236

[51] Int. Cl.[3] ..... B66B 9/00; E06C 7/12

[52] U.S. Cl. ..... 182/103; 182/43; 182/141; 182/82; 187/19

[58] Field of Search ..... 182/103, 102, 101, 82, 182/141, 43; 187/6, 9 R, 19

[56] References Cited

U.S. PATENT DOCUMENTS

| | | | |
|---|---|---|---|
| Re. 15,028 | 1/1921 | Hunter | 187/6 |
| 767,244 | 8/1904 | Rieg | 182/103 |
| 1,634,854 | 7/1924 | Scollard | 187/19 |
| 2,338,833 | 1/1944 | Bailey | 182/103 |
| 2,438,791 | 3/1948 | Russell | 182/103 |
| 2,647,675 | 8/1953 | Bernett | 182/148 |
| 3,141,521 | 7/1964 | Read | 182/141 |
| 3,256,956 | 6/1966 | Puhringer | 182/141 |
| 3,908,801 | 9/1975 | Pohlman | 182/103 |
| 3,946,836 | 3/1976 | Maack | 182/141 |
| 4,018,306 | 4/1977 | Lyons | 182/37 |

FOREIGN PATENT DOCUMENTS

| | | | |
|---|---|---|---|
| 237875 | 1/1965 | Austria | 182/141 |
| 6940444 | 9/1970 | Fed. Rep. of Germany . | |
| 2506528 | 2/1975 | Fed. Rep. of Germany . | |
| 2729381 | 6/1977 | Fed. Rep. of Germany . | |
| 1557662 | 1/1969 | France . | |

*Primary Examiner*—Reinaldo P. Machado
*Attorney, Agent, or Firm*—Karl F. Ross

[57] ABSTRACT

A service elevator, designed to carry persons up or down along a building wall or other structure, comprises a ladder secured to that structure and a carriage on which an endless conveyor band is supported. The band has projecting dogs engaging the rungs of the ladder which are held between a first stringer of circular cross-section and a second stringer of rectangular cross-section. The band-supporting frame has sleeves slidably engaging the first stringer and roller pairs bracketing the second stringer. A second conveyor band, serving as a standby for the working band, corotates therewith and has dogs slightly offset from those of the latter for dropping onto the rungs when the working band fails.

20 Claims, 11 Drawing Figures

LADDER-GUIDED SERVICE ELEVATOR

FIELD OF THE INVENTION

Our present invention relates to a service elevator wherein a platform, cage or other carriage is positively guided along a ladder attached to a steep surface of a building, a scaffolding, a mast or a vehicle and which has a drive coacting with the ladder in order to lift or lower the carriage.

BACKGROUND OF THE INVENTION

Elevatable platforms for transporting persons up and down a steep surface, along a vertical rail secured to that surface, are known. Thus for instance, German laid-open application No. 29 22 859 describes a platform sliding along a guide rail secured to a toothed rack which the platform drive engages via a pinion. This known guide rail has a complicated construction and, without its platform, cannot be used by a person.

German laid-open application No. 25 06 528 discloses a ladder for lifting a platform by means of a worm or leadscrew with turns engaging its rungs. In practice, such an arrangement would require the worm to be tilted with reference to the longitudinal axis of the ladder whose vertical stringers would then have to be far apart so that the ladder becomes very wide. Furthermore, the worm causes friction along the rungs which results in their early wear. This is especially the case with dirty ladders, like those usually found on the outside of exposed structures.

OBJECTS OF THE INVENTION

An object of our present invention, therefore, is to provide a simpler and safer service elevator of the type referred to in which the guide rail is not subject to significant wear and parts undergoing such wear are carried only on the platform and its drive.

A further object of our invention is to keep the widths of the rail and of the ladder to a minimum.

SUMMARY OF THE INVENTION

These objects are attained, according to our invention, by means of dogs which engage the horizontal rungs of the ladder and protrude from an outer surface of an endless conveyor-type band coupled with a drive mechanism, at least one segment of the endless band closely adjoining the ladder. A frame supporting the conveyor band is secured to the platform or carriage for which the ladder, having upright stringers bridged by equispaced rungs, thus acts as a guide rail while being also usable by persons. Even if the platform is absent or held stationary, therefore, it is possible for persons to climb or descend the ladder in case of emergency. Since the rungs of the ladder form abutments for the driving dogs and thus are of sturdy construction, there is no significant wear and tear of the ladder itself. Any worn-out parts can easily be replaced. Furthermore, the ladder can be kept quite narrow to reduce its cost.

Such a vertical guide rail serving as a ladder can be used advantageously especially at stacks, tall buildings, scaffoldings, masts or rescue vehicles, since the movement of the platform therealong is considerably faster than climbing or descending the ladder by muscle power. Thus, for instance, the ascent of a stack requires approximately two hours, while only ten minutes are needed with the platform according to our invention.

The elevatable platform or carriage can be removed from the ladder engaged by it so as to be usable on other, similarly equipped structures. The ladder need not have movable parts, bores or cables for connection with the carriage.

The endless band or conveyor can be a link or gear chain as well as a belt. Such transmission elements not only are of simple construction but also cause no wear to the ladder. Furthermore, it is possible to have always several dogs and a corresponding number of rungs engaged so that, if a rung or a dog fails, the operativeness is preserved.

In order to keep the endless band securely in contact with the ladder, and thereby to ensure proper engagement of the dogs with the rungs, we prefer to back the working run of the band by a sliding surface paralleling the ladder. This run should be at least as long as the distance between two rungs, so that at least two dogs simultaneously engage respective rungs.

For long wear of the parts engaging the ladder or resting against it, as well as of the ladder itself, we prefer to make these parts of synthetic material, especially Teflon.

A safe and wear-free engagement and disengagement of the dogs and the ladder is achieved by slanting the lower end of the working run, confronting the ladder, away from the rungs. Advantageously, the endless band is actuated by an electric motor through a worm gearing.

For additional safety in case of failure of the operating band, a second or fall-back endless band of similar structure can be mounted alongside the former. In order to prevent wear of the dogs of the second conveyor band during operation of the first band, these dogs preferably are positioned with a slight upward offset from the engaged rungs. For protection, the ladder-confronting run of each band may be positioned between the stringers of the ladder.

A safe and slow lowering of the platform or carriage in case of failure of the drive mechanism is achieved by coupling a centrifugal brake with the gearing or with a reversing roller of one or both endless bands. In order to insure a lowering of the platform even when the electric motor is stuck, the motor should be disconnectable from a normally driven reversing roller of the endless band or bands with the aid of a decoupling lever.

Sturdy and long-wearing low-cost rungs can be designed as cylindrical tubes or bars. The stringers of the ladder may consist of steel pipes. According to a more particular feature of our invention, one stringer of the ladder is of rectangular—especially square—cross-section while the other stringer is of circular cross-section. A carriage-supporting yoke has longitudinally slotted guide sleeves sliding on the round-profile stringer and guide rollers bracketing the rectangular-profile stringer so that variations in the spacing of the stringers will not cause jamming.

For the safety of the riders we further prefer to surround the platform or carriage with a guard rail or to shape it as a cage. A portion of the carriage floor may be upwardly swingable to let the occupants descend onto the ladder.

Advantageously, the lowest part of the ladder together with the lowered platform may be detachable from the rest of the ladder. This simplifies the task of connecting the platform with different ladders; furthermore, the missing lower end of the ladder prevents unauthorized persons from reaching the ladder when the platform is not attached.

BRIEF DESCRIPTION OF THE DRAWING

An embodiment of the present invention will now be described in detail with reference to the accompanying drawing in which.

SPECIFIC DESCRIPTION

Figure 1:
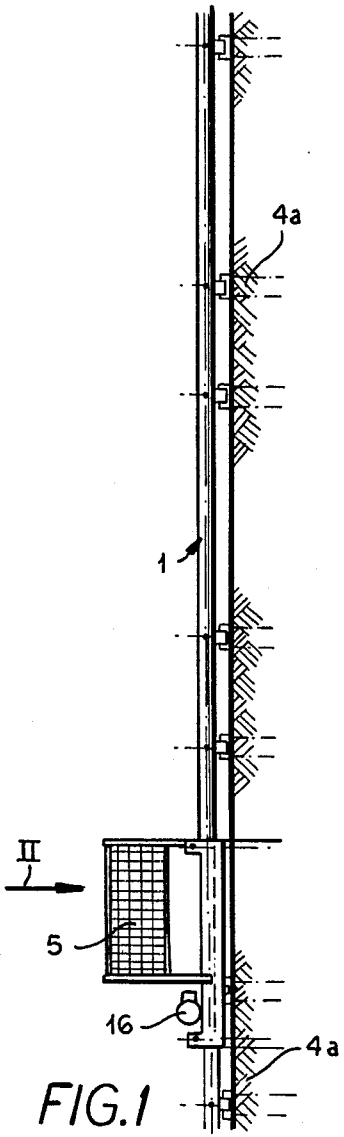
FIG. 1 is a side view of a service elevator according to our invention including a ladder, attached to the front of a building or to a stack, and a carriage movable along the ladder.
Figure 3:
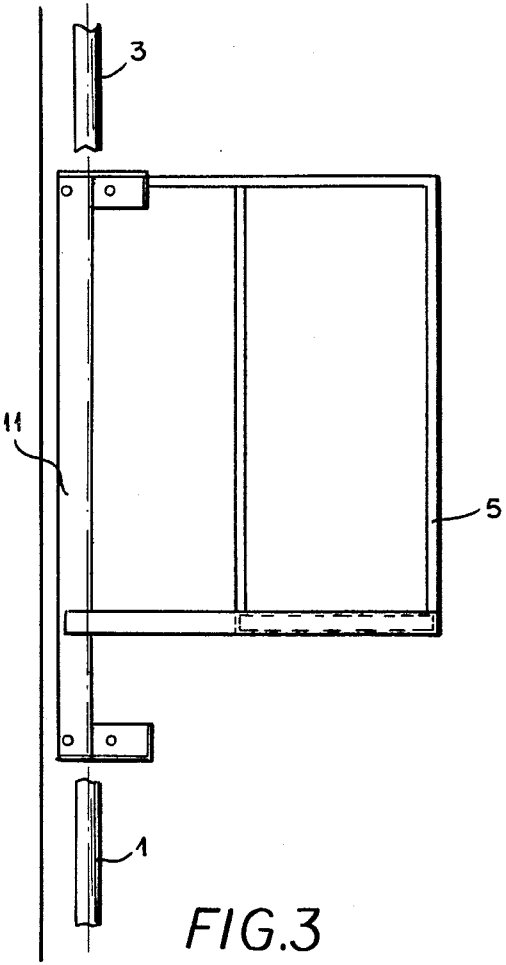
FIG. 3 is a side view drawn to a larger scale and taken in the direction of arrow III in FIG. 2.
Figure 2:
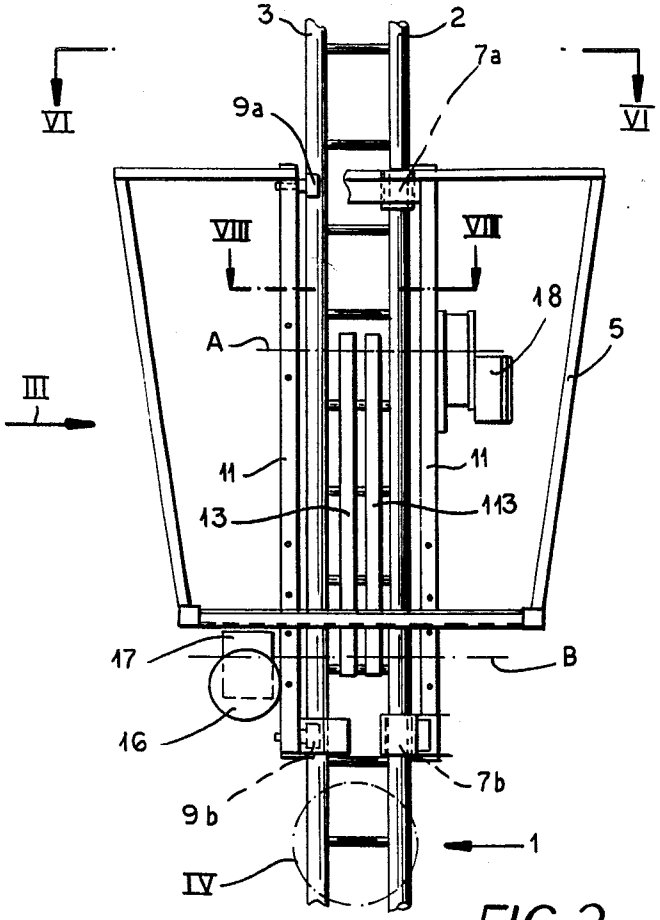
FIG. 2 is a front view of the elevator taken in the direction of arrow II in FIG. 1.
Figure 4:
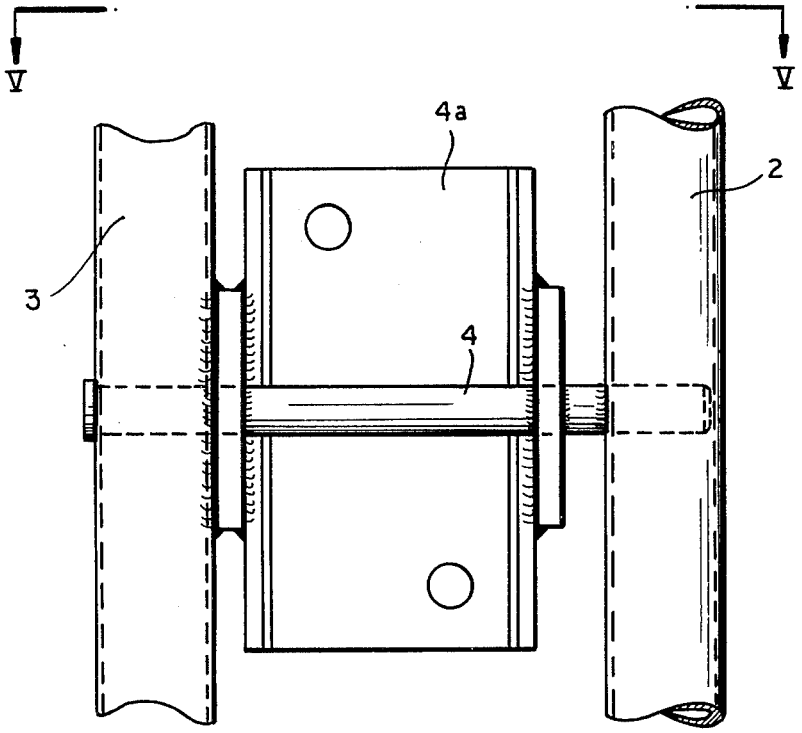
FIG. 4 is a further-enlarged view of a detail marked by a circle IV in FIG. 3.
Figure 5:
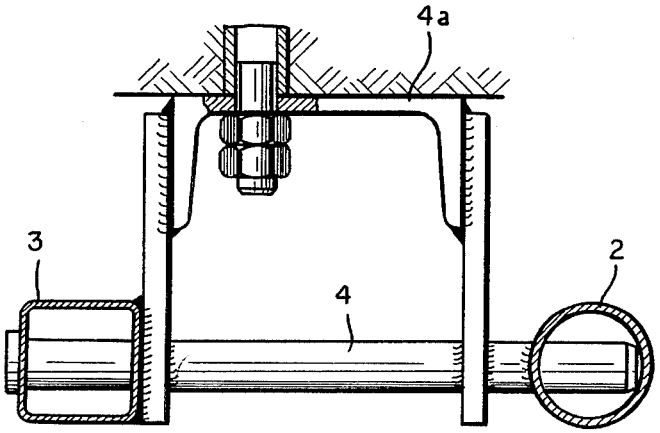
FIG. 5 is a top view taken along line V—V in FIG. 4.

A ladder 1 shown in FIGS. 1–3, 10 and 11 has two essentially vertical stringers 2, 3, the first stringer 2 being a round pipe while the second stringer 3 is a pipe of square cross-section. The diameter of stringer 2 is equal to the width of stringer 3. The two stringers are kept at even distance from each other by rungs 4 that are designed as cylindrical tubes or bars of smaller diameter than the stringers. The horizontal rungs 4 penetrate the stringers 2 and 3 and protrude beyond stringer 3 on the side opposite stringer 2; they can be welded or bolted to the stringers. In order to attach the ladder to a building, scaffolding, mast or vehicle, approximately every fourth rung is traversed by arms of a U-shaped holder 4*a* whose web is pegged into or, as seen in FIGS. 4 and 5, screwed onto the wall of the building or other structure served thereby.

Figure 6:
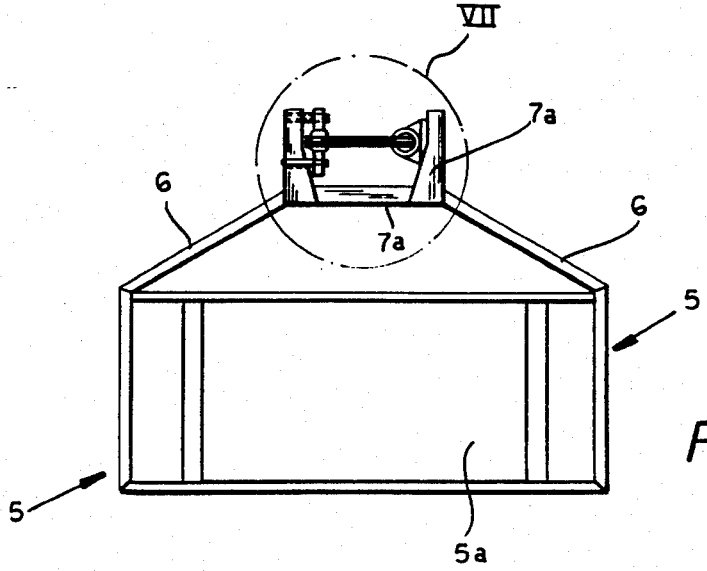
FIG. 6 is a top view taken along line VI—VI in FIG. 2.
Figure 7:
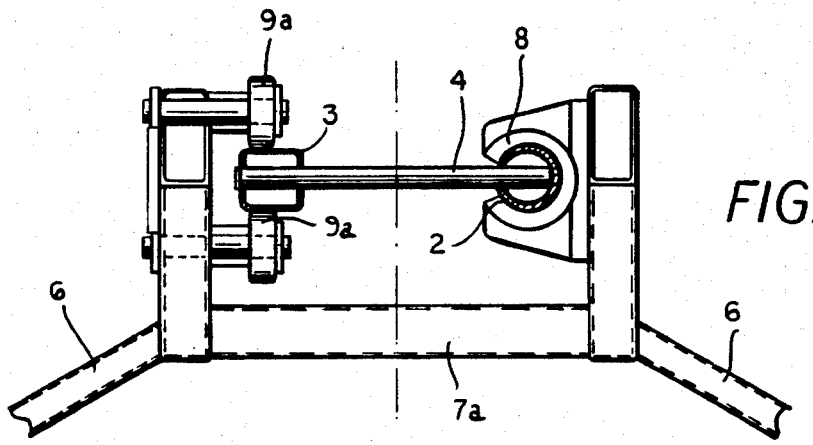
FIG. 7 is a further-enlarged view of a detail marked by a circle VII in FIG. 6.
Figure 9:
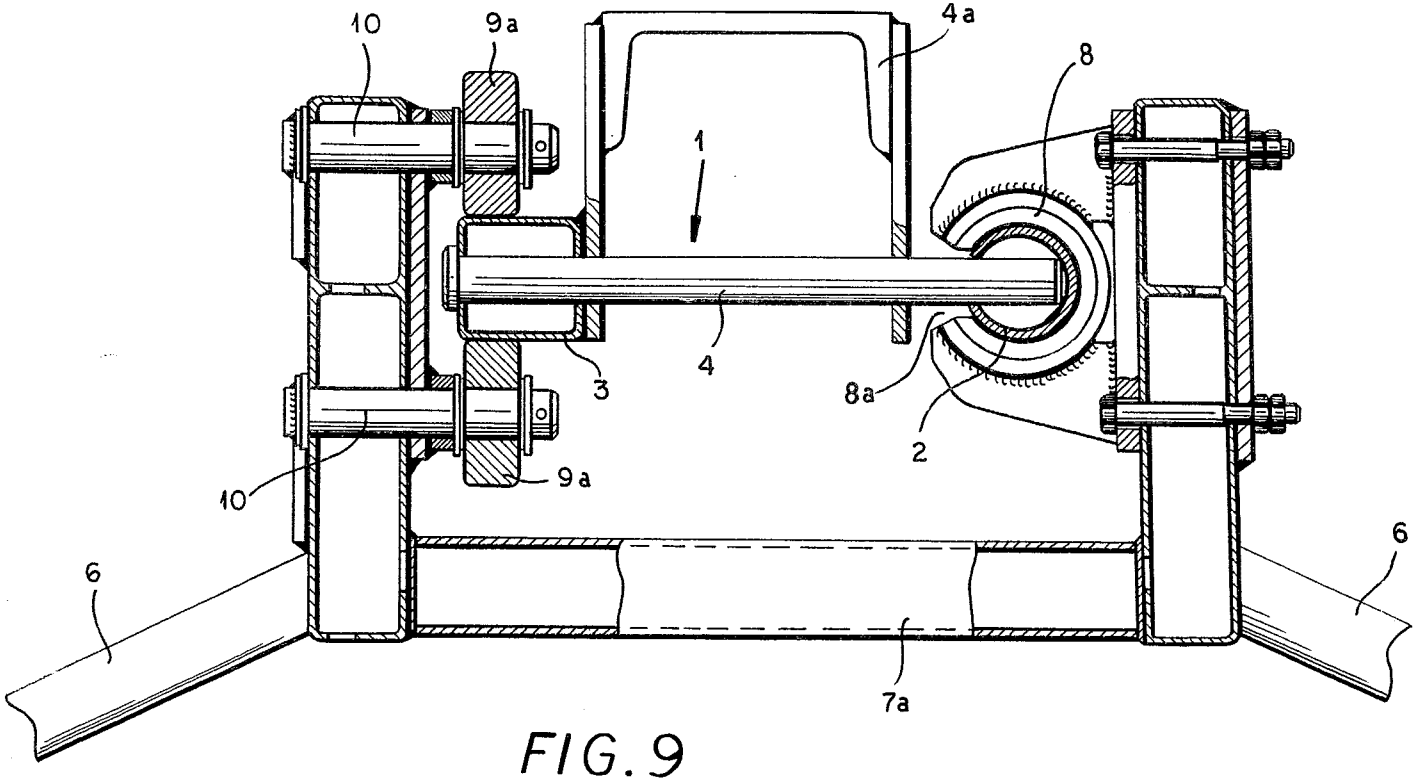
FIG. 9 is a further enlargement of the view of FIG. 7.
Figure 10:
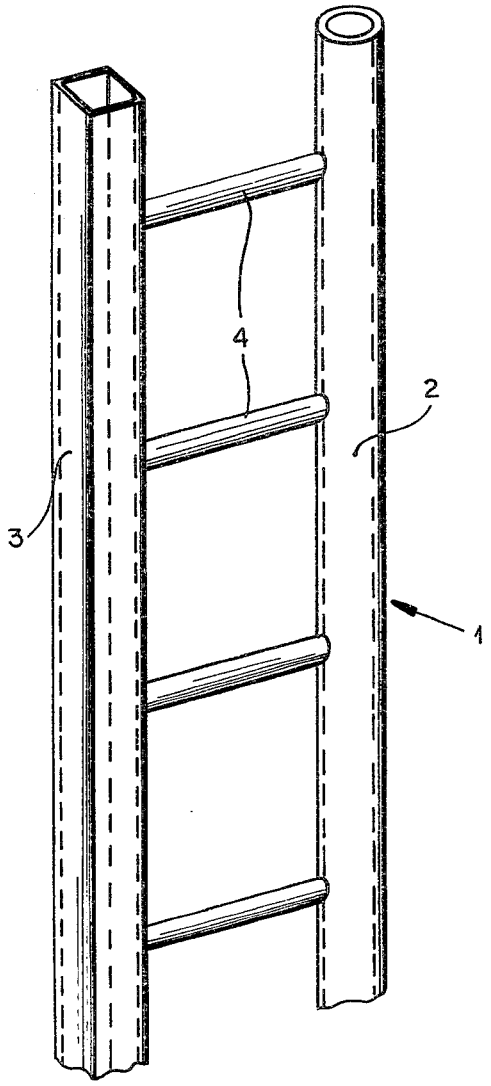
FIG. 10 is an isometric view of part of the ladder.

A platform or cage 5 with a floor 5*a* has struts 6, FIGS. 6, 7 and 9, welded onto an upper and a lower horizontal yoke 7*a*, 7*b* with right-hand branches embracing the round stringer 2 by means of Teflon sleeves 8 each having a longitudinal slot 8*a*. This slot is somewhat wider than the diameter of the rungs 4 in order to let them pass through. The left-hand branches of yokes 7*a*, 7*b* carry respective roller pairs 9*a* and 9*b*, also of Teflon, whose horizontal shafts 10 lie at the same level and are parallel to the rungs. The rollers 9 bear upon the front and rear faces of the flat-sided stringer 3 which are parallel to a common midplane E of the upright stringers; in case of variations in the width of the ladder due to inaccuracies in measurement, the stringer 3 may shift in the axial direction of the rollers 9*a*, 9*b* without disengagement therefrom. Thus, the platform 5 is maintained slidable by a total of at least four rollers and two sliding sleeves.

Figure 11:
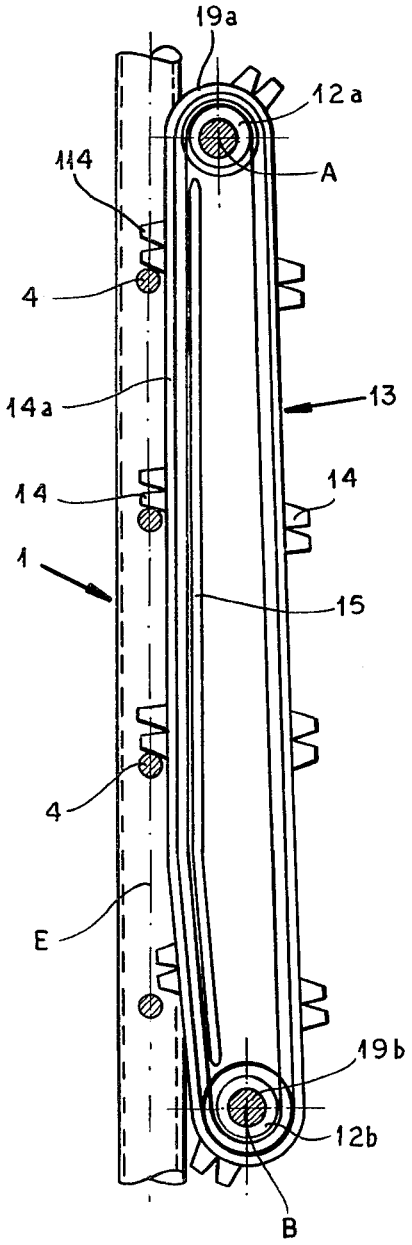
FIG. 11 is a longitudinal sectional view of a portion of the ladder engaged by an endless band entraining the carriage of FIGS. 1–3.

The upper and lower yokes 7*a*, 7*b* are part of a conveyor-supporting frame including vertical stays 11 on which horizontal shafts 19*a*, 19*b* with axes A, B parallel to the rungs (see also FIG. 2) are journaled. The upper and lower shafts 19*a*, 19*b* bear respective gear pairs 12*a*, 12*b*, the upper gears 12*a* being disposed closer to the ladder 1 than the lower gear 12*b* as seen in FIG. 11. These pairs of gears 12*a* and 12*b*, spaced apart from each other by a distance of more than three rung intervals, are enveloped by an endless conveyor band 13 which could be a belt but is here an internally toothed chain in positive engagement with gears 12*a*, 12*b*. The chain 13 carries outwardly directed dogs 14, each designed as a set of teeth made of Teflon, spaced apart by the same distance as the rungs 4. On the active run 14*a* of the chain, facing the ladder 1, several dogs 14 rest on respective rungs when the chain 13 is driven counterclockwise as viewed in FIG. 11. The lower portion of run 14*a* is inclined at an acute angle to the plane E of the ladder so that, when the platform 5 is being raised, the dogs 14 move away slowly from the rungs. On its inside the run 14*a* is backed by a fixed plate 15 with a sliding surface parallel thereto which maintains the engagement of the active dogs 14 with the rungs 4.

Figure 8:
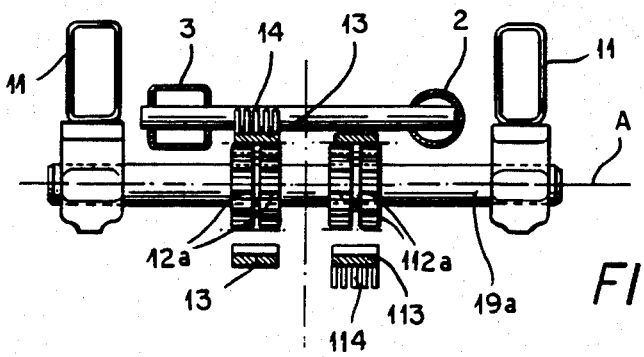
FIG. 8 is a horizontal sectional view taken on line VIII—VIII in FIG. 2.

The lower gear pair 12*b* is driven by an electric motor 16 via a worm gearing 17 allowing this gear pair to be decoupled from the motor via a brake-release lever. The upper gear pair 12*a* is connected with a centrifugal brake 18. A second endless chain 113 (FIG. 8) parallels the operating chain 13 and is similarly constructed, coacting with gears on shafts 19*a*, 19*b* as illustrated in FIG. 8 for an upper gear pair 112*a*. The second endless band 113 moves therefore at the same speed as the first one and codirectionally therewith. The dogs 114 of chain 113 are disposed, on its run confronting the ladder 1, approximately 1 cm higher than the rung-engaging dogs 14 of chain 13 so as not to touch the rungs. This second chain or band 113 is provided merely as a standby for safety reasons and becomes active only in case of failure of the first band 13. In such an event the platform 5 drops down by 1 cm in order to bring into engagement the previously inactive dogs of the second band whose ladder-facing run is also backed by an adjoining and parallel sliding surface.

A part of platform 5, specifically of the floor 5*a* of its cage, is upwardly swingable to create an exit opening for letting a user leave the platform by way of ladder 1.

We claim:

1. A service elevator for transporting persons up and down a steep surface of a structure, comprising:
   - a ladder with upright stringers secured to said structure and equispaced horizontal rungs bridging said stringers;
   - a carriage accommodating a person using the elevator;
   - a frame on said carriage slidably engaging said stringers;
   - endless conveyor means on said frame having dogs spaced apart by the same distance as said rungs for coacting therewith to raise and lower said carriage; and
   - drive means coupled with said conveyor means for operating same.

2. A service elevator as defined in claim 1 wherein said stringers are a first stringer of circular cross-section and a second stringer with two faces paralleling a common midplane of said stringers, said frame being provided with sleeve means embracing said first stringer and roller means bracketing said second stringer in contact with said faces.

3. A service elevator as defined in claim 2 wherein said sleeve means comprises a pair of vertically spaced-apart sleeves with longitudinal slots clearing said rungs.

4. A service elevator as defined in claim 3 wherein said roller means comprises two roller pairs substantially disposed at the levels of said sleeves.

5. A service elevator as defined in claim 4 wherein said roller pairs and said sleeves consist of Teflon.

6. A service elevator as defined in claim 4 wherein said frame comprises an upper and a lower yoke each carrying one of said sleeves and one of said roller pairs.

7. A service elevator as defined in claim 1 wherein said conveyor means comprises at least one endless band developing upper and lower roller means on said frame, said band having an outer surface carrying said dogs.

8. A service elevator as defined in claim 7 wherein said band has a working run confronting said ladder, further comprising backing means inside said band having a sliding surface in contact with said working run.

9. A service elevator as defined in claim 7 wherein said conveyor means further comprises an endless standby band coupled with said drive means for joint rotation with said one endless band, said endless bands having working runs confronting said ladder, said standby band carrying dogs which on the working run thereof are slightly offset in an upward direction from respective dogs on the working face of said one endless band for remaining disengaged from said rungs during normal operation of said one endless band.

10. A service elevator as defined in claim 9 wherein said working runs lie between said stringers.

11. A service elevator as defined in claim 8 wherein the working run of said band has a lower end slanting away from said ladder at an acute angle for gradually separating said dogs from said rungs on a descent of said working run.

12. A service elevator as defined in claim 8 wherein said working run parallels said ladder over at least the spacing of two rungs simultaneously engageable by respective dogs thereof.

13. A service elevator as defined in claim 7 wherein said upper and lower roller means are gears, said band being internally toothed for positive engagement with said gears.

14. A service elevator as defined in claim 7 wherein said drive means is disconnectably coupled with one of said roller means.

15. A service elevator as defined in claim 7, further comprising a centrifugal brake coupled with one of said roller means.

16. A service elevator as defined in claim 2 wherein said second stringer is of square cross-section with a width substantially equaling the diameter of said first stringer.

17. A service elevator as defined in claim 1 wherein said stringers are steel pipes.

18. A service elevator as defined in claim 16 wherein said rungs are cylindrical and penetrate into said stringers.

19. A service elevator as defined in claim 1 wherein said drive means comprises an electric motor coupled with said conveyor means through a worm gearing.

20. A service elevator as defined in claim 1 wherein said carriage is a cage with a swingable part giving access to said ladder.

* * * * *